US009942646B2

(12) United States Patent
McGarry et al.

(10) Patent No.: US 9,942,646 B2
(45) Date of Patent: Apr. 10, 2018

(54) ROBUST AUDIO DEVICE DESIGN

(71) Applicant: Logitech Europe S.A., Lausanne (CH)

(72) Inventors: Steve McGarry, Vancouver, WA (US); William Christopher Carmichael, Vancouver, WA (US); Alexander Samuel Danielson, Vancouver, WA (US); Jeffrey Anderson, Camas, WA (US)

(73) Assignee: Logitech Europe S.A., Lausanne (CH)

( * ) Notice: Subject to any disclaimer, the term of this patent is extended or adjusted under 35 U.S.C. 154(b) by 0 days.

(21) Appl. No.: 15/134,165

(22) Filed: Apr. 20, 2016

(65) Prior Publication Data

US 2017/0019727 A1 Jan. 19, 2017

Related U.S. Application Data

(60) Provisional application No. 62/193,535, filed on Jul. 16, 2015.

(51) Int. Cl.
*H04R 1/10* (2006.01)

(52) U.S. Cl.
CPC ..... *H04R 1/1066* (2013.01); *H04R 1/1033* (2013.01); *H04R 1/1041* (2013.01)

(58) Field of Classification Search
CPC .... H04R 1/1066; H04R 1/105; H04R 1/1033; H04R 1/1041; H04R 5/0335; H04R 5/033
See application file for complete search history.

(56) References Cited

U.S. PATENT DOCUMENTS 4,354,067 A * 10/1982 Yamada ..... A61H 23/0236 381/301
D691,586 S * 10/2013 Clark ..... D14/209.1
2012/0196483 A1* 8/2012 Kuster ..... H01R 27/00 439/626
2013/0051589 A1* 2/2013 Ide ..... H04R 1/1025 381/309
2013/0313097 A1* 11/2013 Yabe ..... H01H 13/705 200/520
2014/0325688 A1* 10/2014 Cashin ..... G06F 21/86 726/34

* cited by examiner

*Primary Examiner* — Fan Tsang
*Assistant Examiner* — Angelica M McKinney
(74) *Attorney, Agent, or Firm* — Patterson & Sheridan, LLP

(57) ABSTRACT

Embodiments of the disclosure provided herein are configured to desirably distribute and thus withstand forces that are applied to an audio device assembly during regular use. The configurations discussed herein can be used to prevent the various device related components from becoming damaged during use. The application of these forces can cause immediate failure of the electrical connections in extreme cases, or more typically cause eventual failure of the electrical connections and device due to repetitive application of the applied force. Therefore, it is desirable to minimize the stress applied to the various electrical connection points during use, such as the electrical connection points.

24 Claims, 12 Drawing Sheets

ROBUST AUDIO DEVICE DESIGN

CROSS-REFERENCE TO RELATED APPLICATIONS

This application claims priority to U.S. Provisional Patent Application Ser. No. 62/193,535, filed on Jul. 16, 2015, which is herein incorporated by reference.

BACKGROUND

Field

Embodiments disclosed herein generally relate to a consumer electronic device that is configured to provide an audio output.

Description of the Related Art

Audio devices allow users to receive audio content or audio information from various media sources, such as internet, video players, gaming devices, music playing platforms or other types of devices. Typical portable audio devices may include wireless speakers, tethered headphones and wireless headphones. Wireless speakers and wireless headphones allow users to be un-tethered to a video, gaming or music playing platform. Wireless headphones are particularly popular among video game players, since a player cannot become entangled in an interconnecting cord while the player is playing the video game. In the case where the wireless headphones are wireless earbuds, it is common to string the part of the earbuds that is inserted into the user's ears together such that they are tethered to the user so that they will not be easily lost by the user. However, conventionally strung earbuds are typically not anchored to the user for comfort and complexity reasons, so it is not uncommon for users to handle these tethered designs by grabbing onto and/or pulling on the interconnecting cable. In conventional designs, the application of a force to the interconnecting cables and connection point(s) formed between the interconnecting cable and earbud/headphone components can cause the electrical connections to become disconnected or less reliable over time.

Conventional headphones that are used with various communication devices typically have buttons which are used to control the delivery of an audio signal to the user and/or remotely control the communication devices. These button initiated functions may include, for example, muting the delivery of audio input to the user or to initiate voice activated dialing. Typically a single press, or a long press, of a button within the headphone device can activate different functions. However, conventional headphone designs typically include structurally separate button assemblies that are attached to a portion of the interconnecting electrical transmission cable that connects the earbud/headphone components, and are not designed to be integrated into a rugged molded headphone assembly.

Therefore, there is a need for a more rugged audio device assembly that is able to support the stresses applied to its various components during normal use and operation. It is also desirable to provide a rugged audio device assembly that has an integrated multi-button control within the formed device.

SUMMARY

Embodiments of the present disclosure relate to an audio device assembly that contains audio components that are interconnected by use of a cable assembly that is configured to electrically interconnect the various audio components.

Embodiments of the present disclosure relate to an audio device, comprising an audio assembly, and electrical interface assembly and a cable assembly. The audio assembly may comprise a first device load support and a first electrical input connection that is in electrical communication with a first speaker, wherein the first device load support is configured to directly or indirectly support the first speaker. The electrical interface assembly may comprise an interface connection and an interface load support, wherein the interface connection is in electrical communication with interface control electronics. The cable assembly may comprise a wiring harness comprising a plurality of wires that electrically connect the first electrical input connection to the interface connection, and a first load supporting element that is coupled to the first device load support and the interface load support.

Embodiments of the present disclosure also relate to an audio device, comprising a first audio assembly, an electrical interface assembly and a first cable assembly. The first audio assembly comprises a first device load support, and a first electronic assembly comprising a first electrical input connection that is in electrical communication with a first speaker. The electrical interface assembly comprises a first interface connection and a second interface connection that are each coupled to an interface printed circuit board, and an interface load support. The first cable assembly comprises a wiring harness comprising a plurality of wires that electrically connect the first electrical input connection to the first interface connection, and a first load supporting element that is coupled to the first device load support and the interface load support.

Embodiments of the present disclosure may also relate to an audio device, comprising a first audio assembly and a first cable assembly comprising a flexible wall. The first audio assembly may include a first electrical input connection that is in electrical communication with a first speaker. The first cable assembly comprising a domed feature that has an inner surface, a supporting wall, a wiring harness comprising a plurality of wires that are electrically connected to the first electrical input connection, a switch and a sealed region. The switch and the wiring harness may be disposed between the flexible wall and the supporting wall. The switch is disposed on a support surface of a supporting element, which is disposed between the flexible wall and the supporting wall, and has a first connection point and a second connection point. The first and second connection points of the switch are each in electrical communication with one of the plurality of wires. The sealed region is at least partially defined by the inner surface and the support surface, wherein the switch is disposed within the sealed region.

Embodiments of the present disclosure may also relate to a method of forming an audio device, comprising forming a flexible wall that has a mounting surface, wherein the flexible wall further comprises a domed feature that has an inner surface, and positioning at least a portion of a wiring assembly over the mounting surface, and the wiring assembly includes a wiring harness that comprises a plurality of wires, a supporting element that has a supporting surface, and a switch that coupled to the supporting element and comprises a first connection point that is in electrical communication with a first wire of the plurality of wires and a second connection point that is electrical communication with a second wire of the plurality of wires. Then sealably bonding the supporting element to the mounting surface to form a sealed region that is at least partially defined by the inner surface and the supporting surface, wherein at least a portion of the switch is disposed within the sealed region.

BRIEF DESCRIPTION OF THE DRAWINGS

So that the manner in which the above recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
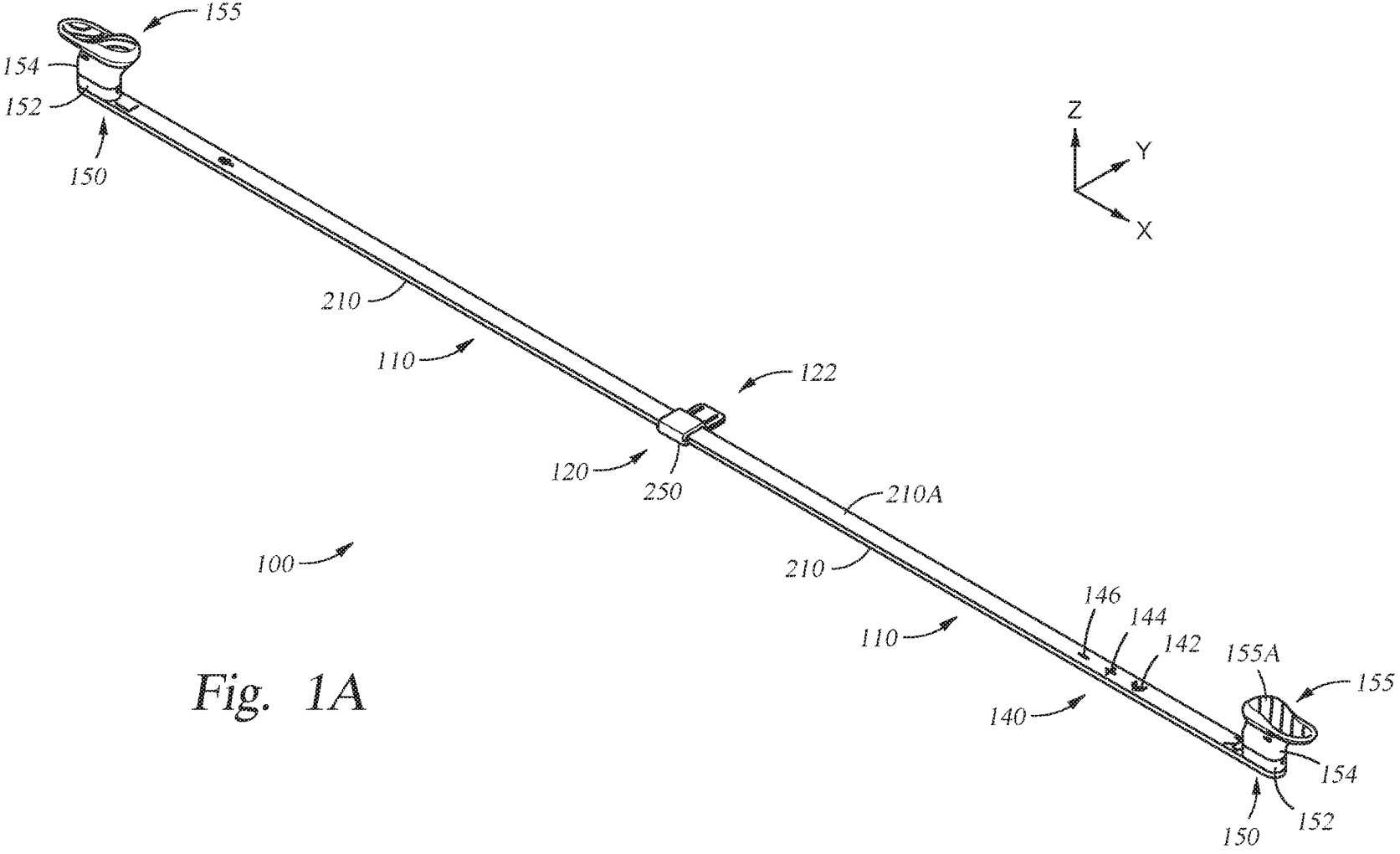
FIGS. 1A-1B are isometric views of an audio device assembly according to one or more embodiments of the present disclosure.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Figure 1B:
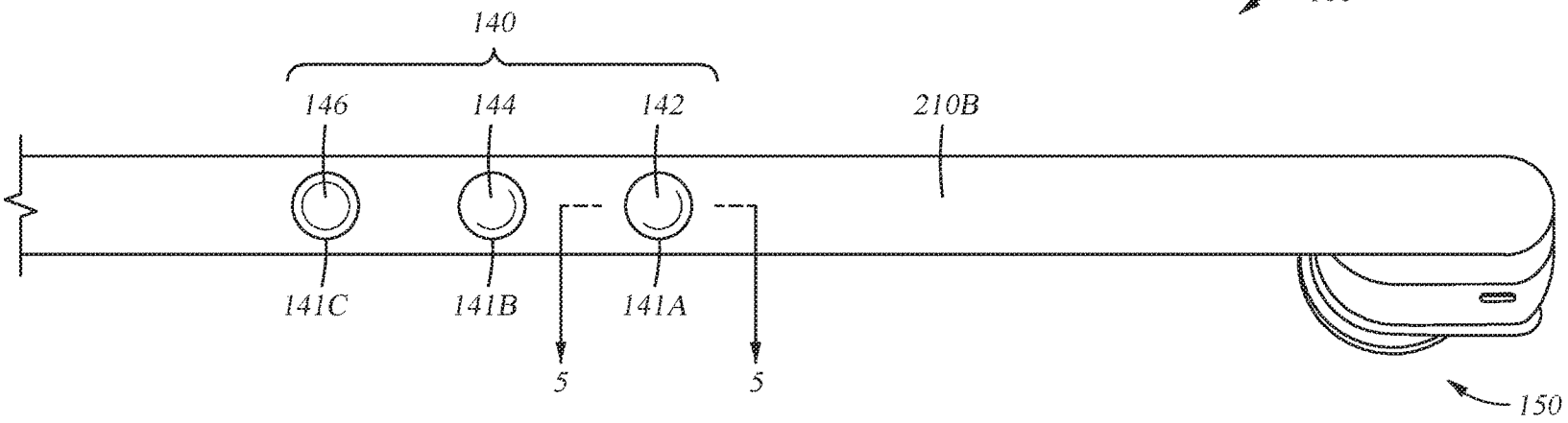

FIG. 1A is an isometric view of an audio device assembly 100 according to an embodiment of the present disclosure. FIG. 1B is a bottom-side isometric view of a portion of the audio device assembly 100 that contains an interface assembly 140 that is included within a cable assembly 110 according to an embodiment of the present disclosure. FIG. 10 is schematic view of the audio device assembly 100 that illustrates at least a portion of the electrical and structural interconnections found in the audio device assembly according to one embodiment of the present disclosure. In some embodiments of the disclosure, the audio device assembly 100 may include two audio output assemblies 150 and a cable assembly 110 that are adapted to deliver audio content to a user. When the audio device assembly 100 is in use a first audio output assembly 150A and second audio output assembly 150B may each be positioned on or inserted within the user's ear to deliver audio content to the user. In one example, the first audio output assembly 150A and second audio output assembly 150B are wireless earbuds, earphones, in-ear monitors, or other similar devices. While the audio device assembly 100 is primarily described herein as being a wireless headphone type system, this configuration is not intended to be limiting as to the scope of the disclosure provided herein since other electronic devices that include an interconnecting cable, such as non-wireless headphone or speaker configurations, may also benefit from the disclosure provided herein.

During normal operation of the audio device assembly 100, a user may handle or grab onto the portion of the cable assembly 110 to remove or reposition the audio device assembly 100. Handling or grabbing onto the cable assembly 110 can generate a force within a portion of the audio device assembly 100 that the user has grabbed onto. For example, a force can be generated between or within an audio output assembly 150 and a portion of cable assembly 110, due to the user's handling of the cable assembly 110. The applied force will cause a load to be placed within the various components found in the stressed portion of the cable assembly 110, the audio output assembly 150 and the interface between the audio output assembly 150 and the cable assembly 110. Various embodiments of the disclosure provided herein are configured to desirably distribute and thus withstand these applied forces to prevent the audio device assembly 100 from becoming damaged, which are a common occurrence in conventional headphone designs found in the market place today. In conventional headphone designs, these types of applied forces are typically transmitted from the user's hand to the shielding of an interconnecting signal transmitting wire in the headphone and then to the electrical connections formed between the signal transmitting wire and the various electronic components (e.g., headphone speakers, 3.5 mm jack, etc.) within the headphone. The application of these forces can cause immediate failure of the electrical connections in extreme cases, or more typically cause eventual failure of the electrical connections due to repetitive application of the applied force. Therefore, it is desirable to minimize the stress transferred to the various electrical connection points in the device, such as the electrical connection points 191 and 192 illustrated in FIG. 10, when a force is applied to the audio device assembly 100 during use.

In general, the audio device assembly 100 contains two or more audio output assemblies 150 that are coupled together by a cable assembly 110. The cable assembly 110 may include an interconnection assembly 120 that is in electrical communication with the two or more audio output assemblies 150 through the cable assembly 110. The cable assembly 110 may include a body 210 that includes a wiring harness 220 (FIG. 10) and one or more load supporting assembly 225 (FIG. 10). The body 210 may have a top surface 210A and an opposing bottom surface 210B. The body 210 will generally include a molded plastic, elastomer or other similar material that is configured to enclose and/or encapsulate the components within the wiring harness 220 and load supporting assembly 225. In some embodiments, the body 210 may be formed from a flexible a thermoset type elastomer or a flexible thermoplastic type elastomer, such as a silicone rubber material.

The wiring harness 220 generally includes a plurality of electrical conductors that are adapted to supply power, provide a reference signal (e.g., ground) and/or transfer electrical signals between the various electrical components in the audio device assembly 100. The wiring harness 220 may contain at least two electrically isolated wires 222, such as about six to ten wires in some configurations. The wiring harness 220 is generally used to interconnect the various electrical components in the audio output assemblies 150 and/or electrically connect the audio output assemblies 150 to an interconnection assembly 120. In one configuration, the wiring harness 220 includes a plurality of flexible stranded wires 222, such as 22 to 38 gauge (AWG) stranded copper wires. The stranded wires 222 may be separately jacketed to prevent electrical shorts between adjacently positioned wires 222. In some configurations, each strand of the stranded wire 222 may be separately jacketed to prevent electrical shorts between strands.

The interconnection of the audio output assemblies 150 and interconnection assembly 120 is made through the connection points 191 and 192, which are also referred to herein as an input connection and an interface connection, respectively. The electrical connection points 191 and 192 are connecting elements that may each comprise an electrical connector, solder joints, bonding pads or other similar device or element that is configured to electrically connect the wires 222 to the electrical components in the audio output assemblies 150 and the interconnection assembly 120.

The load supporting assembly 225 includes one or more load supporting elements 230 that couple the load supporting elements in the audio output assemblies 150 to the interconnection assembly 120. The load supporting element 230 is a flexible filament, such as a cable, string, wire, thread or fiber, that is disposed within the cable assembly 110. The one or more load supporting elements 230 are configured to support at least a portion of the forces applied to the cable assembly 110, audio output assemblies 150 and/or interconnection assembly 120 during use. A load supporting element 230 may be a 0.01 mm to 3 mm diameter filament that is formed from a polymer material (e.g., ultra-high molecular weight polyethylene (UHMW-PE) material), nylon fiber, an aramid fiber (e.g., Kevlar™ fiber), stranded metal wire (e.g., stranded copper wire), or other useful material.

The interconnection assembly 120, which is discussed further below, may include a device connector 122 that is adapted to electrically connect electrical components within the audio device assembly 100 to an external device, such as a computer, tablet, cell phone, audio delivery device or other useful electronic device. In one example, the device connector 122 is adapted to be coupled to a universal serial bus (USB) port of a computer. When the device connector 122 is connected to a computer it is adapted to deliver power to one or more batteries in the audio device assembly 100 and/or deliver information (e.g., digital audio data, digital media, etc.) to various components found within the audio device assembly 100.

The audio device assembly 100 may also contain an interface assembly 140 that is used to control the delivery of information to the user through the two or more audio output assemblies 150 and/or provide input to a processor within the audio device assembly 100 so that one or more functions can be performed by one or more electronic components within the audio device assembly. The interface assembly 140 may contain one or more input assemblies that are adapted to provide input to the processor when actuated by the user. In one example, the interface assembly 140 includes a first input assembly 142, a second input assembly 144 and third input assembly 146. Each of the input assemblies may contain an input receiving feature 141 (FIG. 1B) that is adapted to receive the input from the user, such as by depressing a portion of the input receiving feature to cause a switch within the input assembly to be actuated, as is discussed further below. In one configuration, the interface assembly 140 includes first, second and third input assemblies that each contain an input receiving feature 141A, 141B, 141C (FIG. 1B), respectively. Referring to FIG. 10, each of the input receiving features 141 include a switching device that is coupled to one or more components in the wiring harness 220 to provide a signal to the electrical components positioned in the audio output assemblies 150 and/or interconnection assembly 120.

Each of the audio output assemblies 150 generally includes a connection assembly 152, a component assembly 154 and a user interface element 155. The user interface element 155 generally includes a molded or formed component that is adapted to be attached to or positioned on a user during operation. In one example, the interface element 155 is an earbud type of component that is adapted to be at least partially inserted within an ear canal of a user. The connection assembly 152 in each of the audio output assemblies 150 is generally used to join or couple the components in the cable assembly 110 to the various elements in the component assembly 154, and will be discussed in further detail below.

A component assembly 154 includes various structural and electrical components used to provide the desired information to the user during operation. In some configurations, the component assembly 154 may include the connection assembly 152, a body 321 (FIG. 3A), and an output electrical assembly 107 (FIG. 10). The output electrical assembly 107 may include a speaker 111, speaker driver assembly 106, a transceiver 115, a memory unit 108 and a battery 109.

In some embodiments, the component assembly 154 in at least one of the two or more audio output assemblies 150 includes a speaker driver assembly 106, a transceiver 115, a memory unit 108 and/or a battery 109. Thus, in some configurations these electrical components are shared between the audio output assemblies 150 by use of the wiring harness 220 components. In other words, in some configurations, the audio device assembly 100 may only include one speaker driver assembly 106, transceiver 115, memory unit 108 and/or battery 109, as an alternate configuration to the one illustrated in FIG. 10. Alternately, in some configurations, the electrical components illustrated in each of the audio output assemblies 150 in FIG. 10, such as the speaker driver assembly 106, transceiver 115, memory unit 108 and battery 109, may instead be disposed in the interconnection assembly 120. In this configuration, one or more of the electrical components may be coupled to the speakers 111 found in each of the two or more audio output assemblies 150 by use of the components in the wiring harness 220.

The transceiver 115 is adapted to receive audio signals from an audio source 195 through a wireless communication link 196, and thus can be used to generate an acoustic output by use of a speaker 111 without being physically connected to the audio source 195. The audio source 195 may be any electronic device capable of transmitting an audio signal by wireless communication. The audio source 195 may be a video game console, a personal computer, a tablet computer, a laptop computer, a digital music player, a cell phone (e.g., a smart phone), an stereo system, a television, a video player (e.g., a DVD player, a Blu-ray player), a radio, or other similar device. The audio source 195 may include one or more transceivers configured to establish one or more different types of wireless communication links with the transceiver 115, such as a Wi-Fi communication link, a Bluetooth® communication link, Avnera Audio Link (AAL) or near field communication (NFC) link. In some configurations, the audio source 195 is only required to communicate with a transceiver 115 in a first audio output assembly 150, which then relays the received information to the electrical components in a second audio output assembly 150 using the one or more of the components in the wiring harness 220.

The speaker driver assembly 106 may include a processing unit (not shown) that is configured to receive signals from the transceiver 115 and transfer the processed audio data (e.g., audio output information) to the speaker 111. In one embodiment, the audio output assembly 150 is configured to primarily deliver the audio data to a user that is positioned adjacent to a front surface 155A of the interface element 155. The processing unit may be a hardware unit or combination of hardware units capable of executing software instructions and processing data. For example, the processing unit may be a central processing unit (CPU), a digital signal processor (DSP), an application-specific integrated circuit (ASIC), a combination of such units, and so forth. The speaker driver assembly 106 also contains one or more components that are configured to drive the speaker 111 so that the audio signal received from the transceiver 115 can be delivered to the user through the speaker 111. The speaker driver assembly 106 may include a memory unit 108 that is coupled to the processing unit. The memory unit may include any technically feasible type of hardware unit configured to store data, such as a hard disk, a RAM module, a flash memory unit, or a combination of hardware units for storing data. The speaker driver assembly 106 may also further include a software application (not shown) that is stored within the memory unit 108. The software application may include program codes that may be executed by the processing unit to perform various functionalities associated with the audio output assembly 150. In one configuration, the software applications are configured to adjust one or more of the activities performed by the audio components based on information received by one or more sensors (e.g., switches) or the transceiver 115. The activities may include, but are not limited to, turning on or off the audio component, putting the audio component in a "sleep" mode, adjusting the audio output parameters (e.g., volume, EQ settings, etc.) or other useful activities. The speakers 111 can include any conventional audio generating device, such as a device that includes a primary magnet (not shown) and a coil (not shown) that are configured to cooperatively drive a membrane (not shown) to generate an audio signal based on a signal sent from the speaker driver assembly 106.

Figure 2A:
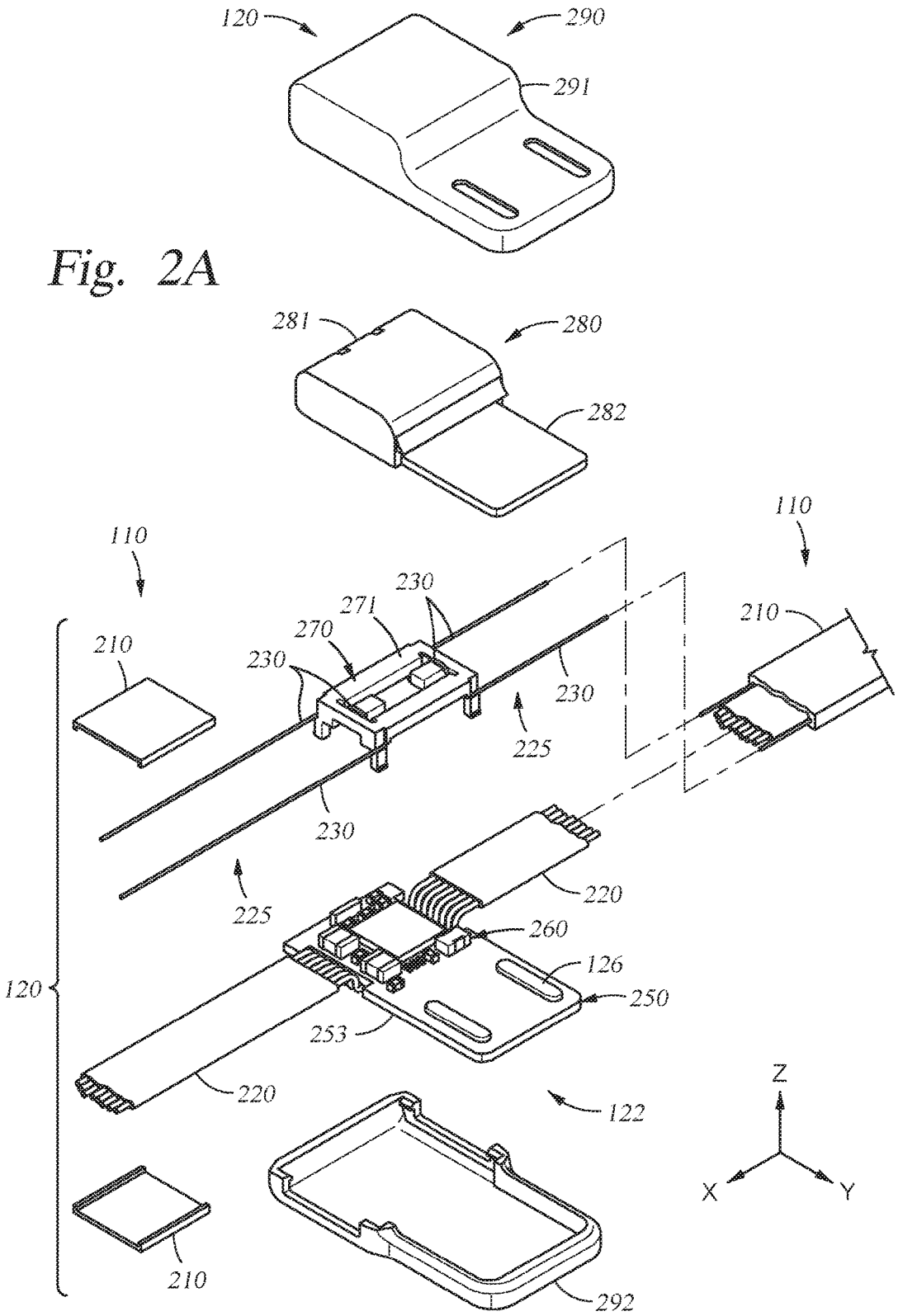
FIG. 2A is an exploded isometric view of an interconnection assembly of the audio device assembly according to one embodiment of the present disclosure.

FIG. 2A is a partial exploded view of the interconnection assembly 120 that includes the device connector 122, and an interface electronic assembly 250 and a central structural element 270 that are each coupled to portions of the cable assembly 110. The interface electronic assembly 250 may include a printed circuit board 253, which includes the control electronics 260 that are in communication with the connector pins 126 of the device connector 122 and the plurality of electrical conductors, or wires 222 (FIG. 2B), of the wiring harness 220. The control electronics 260 may include an I/O assembly 125 and various interface and supporting electronic components. Collectively the interface and supporting electronic components include one or more devices that enable the transmission of signals and power received through the device connector 122 and/or received by one or more of the electrical devices in the component assembly 154 in the one or more of the audio output assemblies 150. In one configuration, the interface and supporting electronic components may include a processor 128, a memory unit 129 and transceiver unit 127 that are in communication with the I/O assembly 125. In this configuration, one or more of the output electrical assemblies 107 in one or more of the component assemblies 154 may not contain the same duplicative elements. The transceiver unit 127 may include one or more wireless transceivers that are configured to establish one or more different types of wireless communication links with transceivers residing within a computing device (e.g., audio source 195). Alternately, the transceiver unit 127 may include one or more wired transceivers that are configured to establish a wired communication links with a transceiver residing within a computing device by use of the pins 126 in the device connector 122. In some embodiments, the I/O assembly 125 may include various wiring elements and other useful signal transmission devices.

The interconnection assembly 120 may also include a molded feature 280 that includes a cable assembly section 281 and optionally an interface element section 282. The molded feature 280 may include a moldable or castable material that is used to hold the electrical and structural components in the interconnection assembly 120 in a desired configuration during use. The molded material may include a silicone rubber, epoxy, thermoplastic materials, viscous adhesives or other useful non-conductive structurally supporting material.

The interconnection assembly 120 may further include a packaging assembly 290 that is configured to enclose at least portions of the interface electronic assembly 250, central structural element 270 and portion of the cable assembly 110. The packaging assembly 290 may include a top cover 291 and bottom cover 292 that are configured to enclose the molded feature 280, the structural element 270, the printed circuit board 253 and portions of the device connector 122 that do not include the pins 126. The top cover 291 and bottom cover 292 may be formed from a coated metal, plastic or elastomeric material.

Structural Element Configuration Examples

Figure 2B:
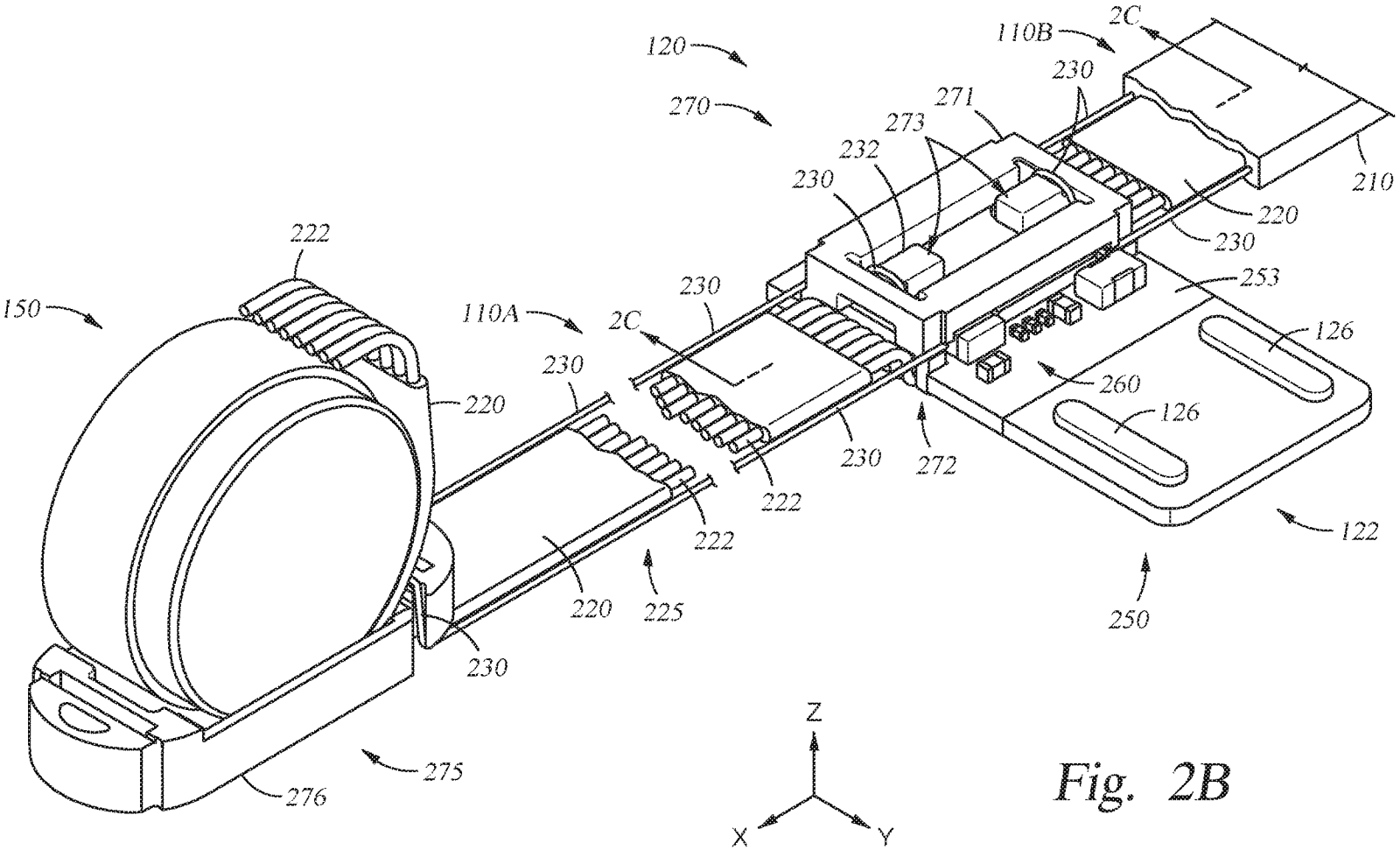
FIG. 2B is an isometric view of a partial section of the interconnection assembly of the audio device assembly according to one embodiment of the present disclosure.

In some embodiments, the audio device assembly 100 is configured to withstand the forces supplied to various portions of the audio device assembly by a user during operation. In general, the load bearing and/or structural designs disclosed herein can be used to reduce the stresses applied to the various electrical components and electrical connection points (e.g., connection points 191 and 192 illustrated in FIG. 10) within the audio device assembly 100 to avoid premature failure of the device. To facilitate the reduction in stress in the electrical connection points and electrical components, the audio device assembly 100 includes a central structural element 270 and one or more output assembly structural elements 275 (FIGS. 2B and 3B). FIG. 2B is a partial isometric view of the cable assembly 110 that illustrates the major load bearing components in the central structural element 270 and output assembly structural element 275. In some embodiments, the central structural element 270 includes a central load support 271 (e.g., interface load support) that is configured to engage with the load supporting element(s) 230 of the cable assembly 110, and the output assembly structural element 275 includes a device load support 276 that is configured to engage with the opposing end of the load supporting element 230. The output assembly structural element 275 will be discussed in conjunction with FIGS. 3A and 3B in greater detail below.

When the audio device assembly 100 is fully assembled, the central structural element 270 and output assembly structural element 275 are coupled together via the load supporting element(s) 230. In this configuration, when a tensile load is applied to the audio device assembly by a user, the applied loads are taken up by the load supporting element 230, central structural element 270 and output assembly structural element 275 versus the electrical components found within the audio device assembly 100. In one example, when a tensile load is applied by pulling on portions of the cable assembly 110 that are on opposite sides of the interconnection assembly 120 (e.g., −X and +X-directions in FIG. 1A), the applied tensile load will be substantially transmitted through the load supporting elements 230 in the cable assembly 110 and the central load support 271 versus the flexible stranded wires 222 of the wiring harness 220 and/or printed circuit board 253.

In some embodiments, as illustrated in FIG. 2B, the cable assembly 110 includes two sections (e.g., sections 110A and 110B) that each extend from the interconnection assembly 120 to an audio output assembly 150. In this configuration, the load supporting elements 230 in each section are coupled to one side of the central load support 271 and a portion of the device load support 276. At the central load support 271 region of the audio device assembly 100, the load supporting elements 230 in each section are intertwined with features of the central load support 271 to distribute any applied force and to connect the ends of the load supporting elements 230. In one example, the load supporting elements 230 in each of the sections of the cable assembly 110 are wrapped around the support legs 272 and a support element 232 of a central leg 273 of the central load support 271. In one embodiment, the ends of each of load supporting elements 230 in a section are tied together in a knot, clasped together using a clip, bonded together, or joined by any other desirable end joining method that can be used after intertwining the load supporting elements 230 around the features of the central load support 271. In another embodiment, each of the ends of each of the load supporting elements 230 in a section are each intertwined with a retaining feature (not shown) in the central load support 271 that is adapted to hold or retain a portion of load supporting elements 230 by the compression and friction created between the load supporting elements 230 and the central load support 271.

Figure 2C:
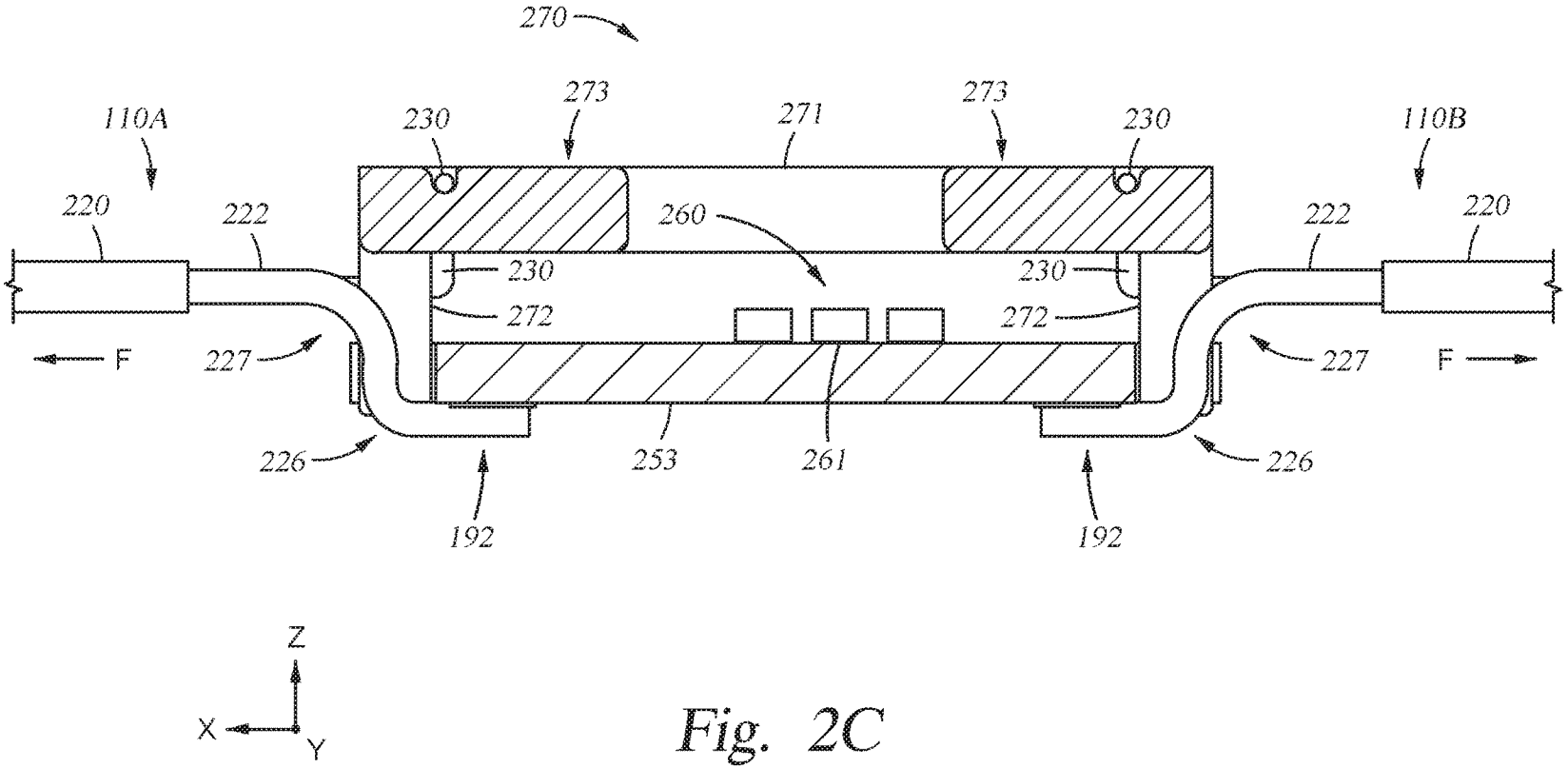
FIG. 2C a side cross-sectional view of an interconnection assembly of the audio device assembly illustrated in FIG. 2B, according to one embodiment of the present disclosure.

FIG. 2C is a side cross-sectional view through the center of the interconnection assembly 120 and central portions of the cable assembly 110 illustrated in FIG. 2B. One will note that the load supporting elements 230 are partially obscured in FIG. 2B by the wires 222 of the wiring harness 220, since, in some embodiments, the load supporting elements 230 in the cable assembly 110 are positioned in the same plane (i.e., X-Y plane) as the wires 222 of the wiring harness 220. In one configuration, one or more of the wires 222 in each section of the cable assembly 110 are electrically coupled (e.g., soldered, mounted in a connector, etc.) to the printed circuit board 253 at the connection point 192. The wires 222 within the wiring harness 220 may also contain a one or more bends 226, 227 that are used in conjunction with the load supporting elements 230 to reduce or prevent an applied force "F" from being transmitted to the connection point(s) 192. The bends 226, 227 may each be formed so that they have a radius of curvature that extends over an angle of between about 15 and about 135 degrees, such as 90 degrees as illustrated in FIG. 2C. As noted above, the transmission of the applied force "F" to the connection points 192 can lead to immediate or eventual failure of the device. However, by use of one or more of the configurations disclosed herein, the applied force "F" will only tend to straighten the flexible wires 222 at the bends 226, 227 versus transmit the applied force "F" to the connection point 192. Also, by positioning and coupling the ends of the load supporting elements 230 together so that they have no slack, or excess length, a substantial portion of the applied load will be taken up by the load supporting elements 230 and central load support 271 versus taken up by the electrical connection points 192.

While not intending to be bound by theory, in some cases the material that is used to form the load supporting elements 230 is selected so that a significant portion of the applied load is taken up by the load supporting elements 230 versus the wires 222. In some cases, the modulus of elasticity (E) and yield strength ($\sigma_y$) of the load supporting elements 230 is selected to assure that forces applied during normal operation are substantially taken up by the load supporting elements 230 versus the wires 222. In one example, the tensile modulus of the material in the load supporting elements 230 is selected to be at least greater than 100,000 psi, or even at least 1,000,000 psi. Therefore, if it is assumed that the strain ($\in$) in two materials (e.g., wires 222 material and load supporting elements 230 material) that are loaded in parallel by a tensile force are equal, then by using Hooke's law (i.e., $\sigma=E\cdot\in$), the percentage of the force taken up by each of the materials is proportional to the ratio of the modulus of elasticities of the materials. Therefore, by selecting a material, from which the load supporting elements 230 is made, that has a desirable modulus of elasticity (E) versus the modulus of elasticity (E) of the wires 222, a desired proportional amount of an applied force can be taken-up by the load supporting elements 230 when a force is applied. It should be noted that this discussion fails to account for the added benefit of providing bends and slack in the wiring harness 220 components, which will tend to desirably increase the percentage of the load taken-up by the load supporting elements 230. In one example, due to the structural configuration and material properties of the load supporting elements 230, supports 271, 276 and wires 222, the load supporting elements 230 and supports 271, 276 in each section of the audio device assembly 100 are adapted to bear or take-up at least 25% of the applied force, or even greater than 75% of the applied force, or even greater than 90% of the applied force.

In some embodiments, the printed circuit board 253 is mechanically coupled to, or engaged with, the central load support 271 to prevent significant relative motion between these components. In this case, any load applied to the device connector 122, such as when it is inserted into a computer port, will be at least partially supported by the central load support 271 to minimize the amount of load that is applied to the connection points 192. However, in some alternate embodiments, the printed circuit board 253 may not be mechanically coupled to, or engaged with, the central load support 271, and thus may only be positioned adjacent to the central load support 271. In this configuration, the printed circuit board 253 and wires 222 are at least allowed to "float" or freely move in at least one direction relative to the central load support 271. In one configuration, the printed circuit board 253 and wires 222 are allowed to freely move in the plus and minus X and Y-directions, so that any bending moment or force generated by the application of an applied force to the cable assembly 110 will be transmitted to the central load support 271 via the load supporting elements 230, and not to the connection points 192. In some configurations, it may also be desirable to allow the printed circuit board 253 and wires 222 to also freely move in the plus and minus Z-direction.

Figure 1C:
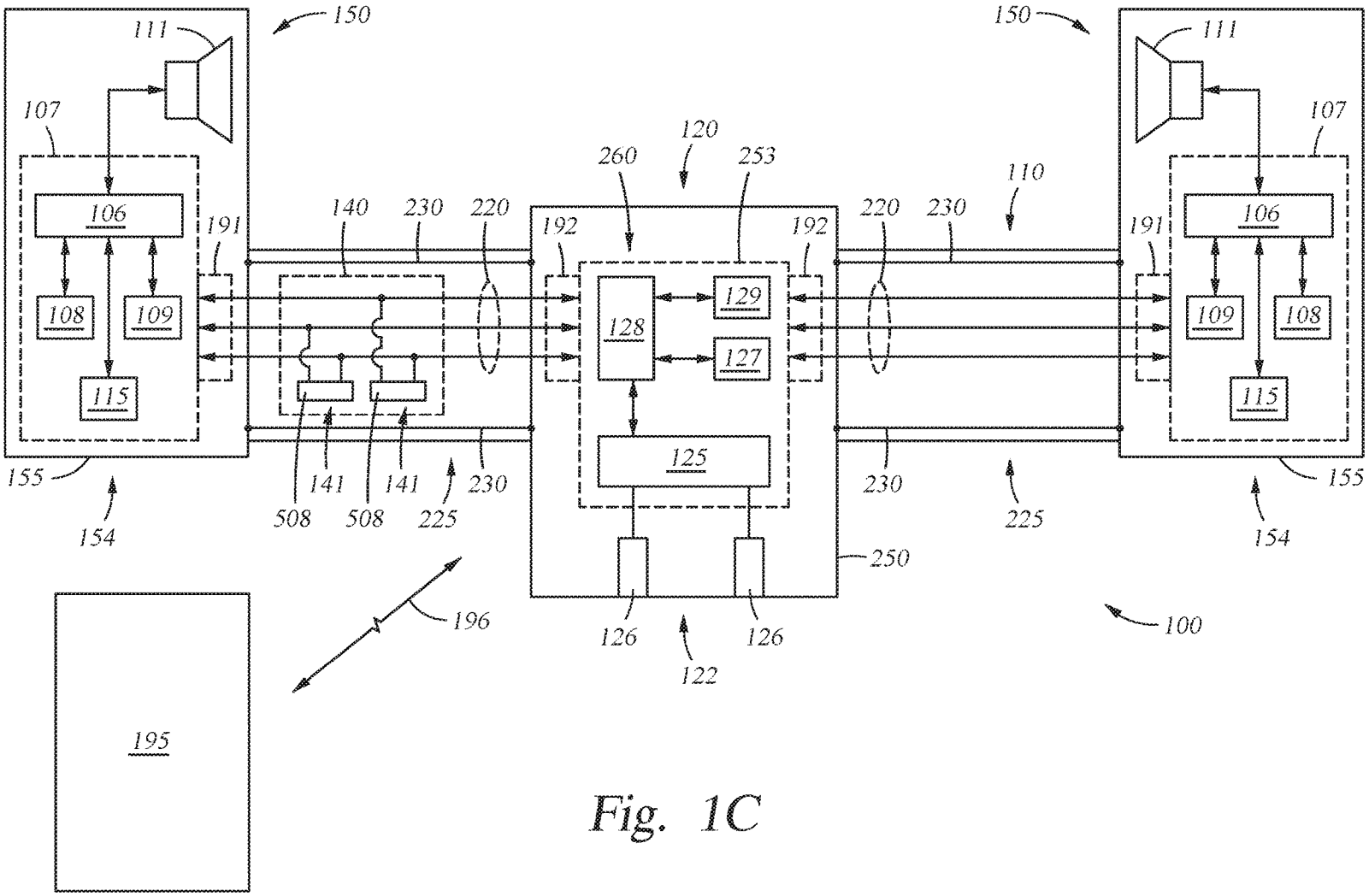
FIG. 1C schematically illustrates various interconnected electronic elements within the audio device assembly shown in FIGS. 1A-1B, according to one embodiment of the present disclosure.
Figure 3A:
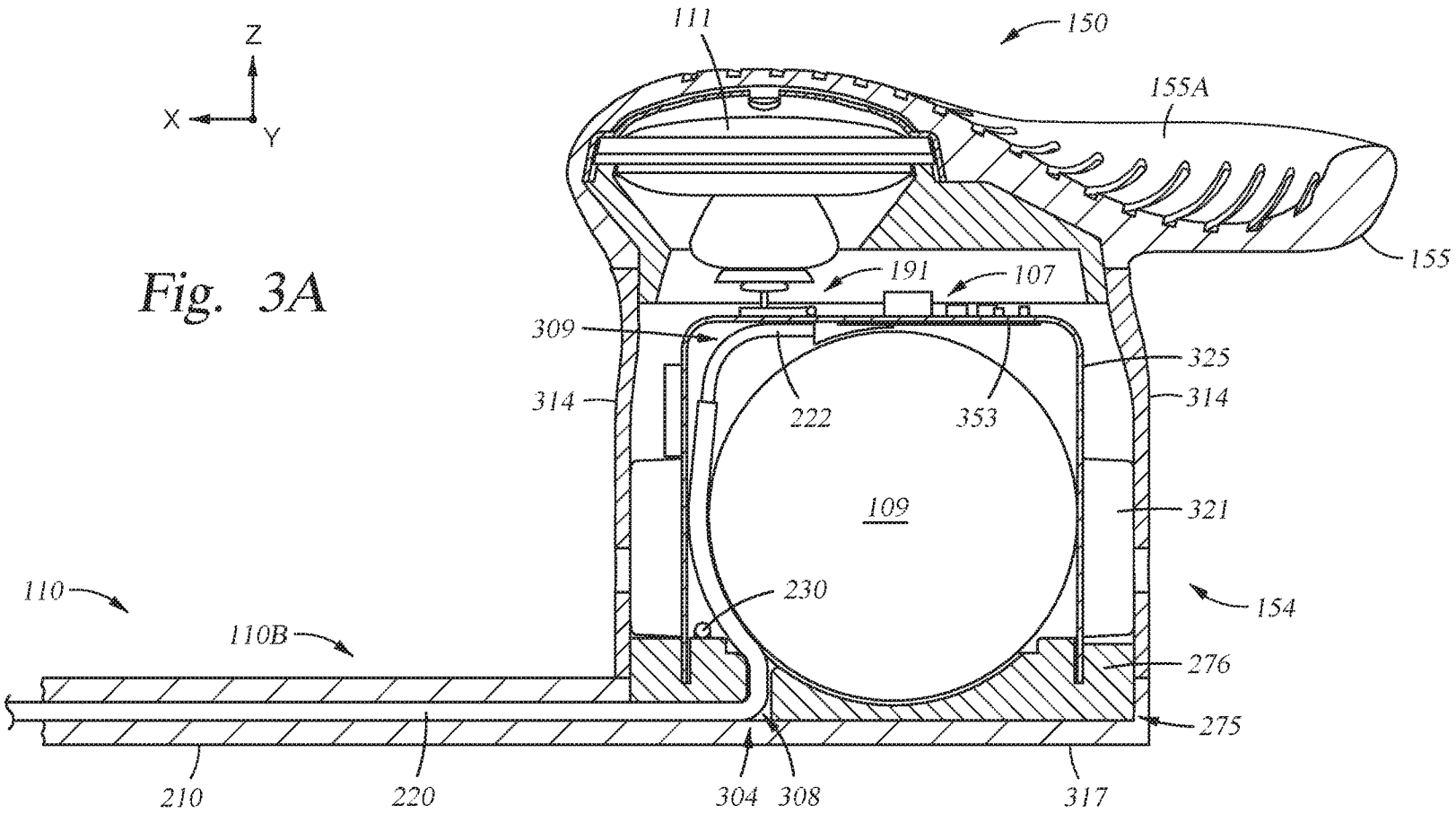
FIG. 3A is a schematic side cross-sectional view of an audio output assembly of an audio device assembly according to embodiments of the present disclosure.
Figure 3B:
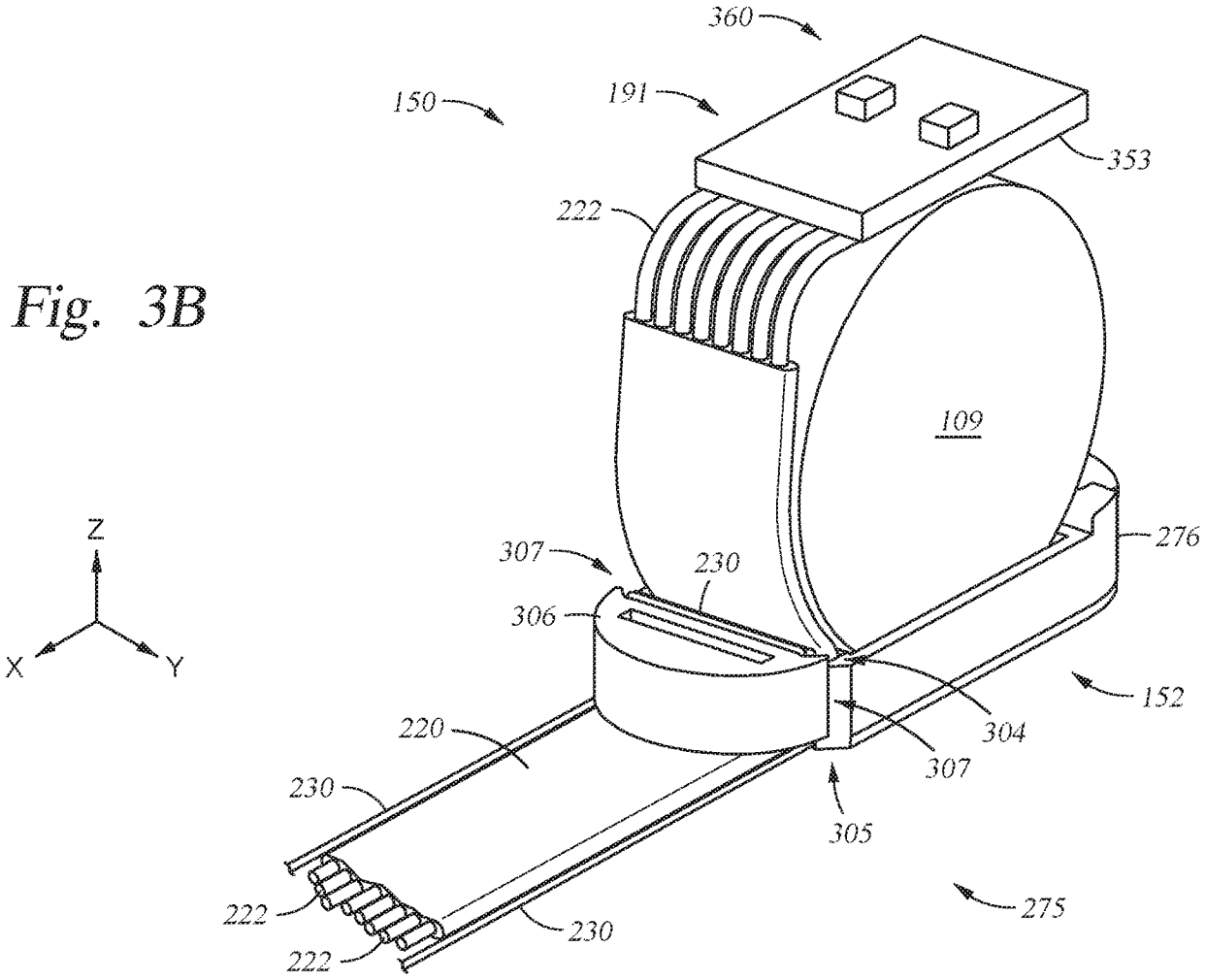
FIG. 3B is an isometric view of a section of the output assembly structural elements within the audio output assembly according to one or more embodiments of the present disclosure.

FIG. 3A is a side cross-sectional view of the audio output assembly 150, which is coupled to portions of the cable assembly 110. The audio output assembly 150 generally includes the output assembly structural element 275, the output electrical assembly 107 and the body 315. As discussed above, the output electrical assembly 107 includes various electrical components, such as the speaker 111 that are used to deliver an audio output to a user. Collectively the output electrical assembly 107 includes one or more electrical devices that enable the processing and transmission of an audio signal received from one or more the components in the output electrical assembly 107 and/or control electronics 260 (FIG. 1C) to a user. In some embodiments, the output electrical assembly 107 may include a printed circuit board 353, which includes the control electronics 360 (FIG. 3B) that is in communication with the plurality of wires 222 of the wiring harness 220 through the connection point 191. The control electronics 360 may also include I/O and other supporting electrical components that enable the processing and transmission of signals, and power received from the battery 109, so that an audio output can be supplied to the user.

The audio output assembly 150 may also include a body 315 and a supporting structure 325 that is coupled to the device load support 276. The supporting structure 325 can be a sheet metal piece that is used to support the output electrical assembly 107 components, such as the speaker 111 and the printed circuit board 353, and provide support for the body 315. In one configuration, the supporting structure 325 is attached to and/or supported by the device load support 276, and thus in this case the electrical assembly 107 components are indirectly supported by the device load support 276. The body 315 may include a plurality of walls 314, 317 that are used to enclose at least a portion of the output assembly structural element 275 and the output electrical assembly 107 elements. The body 315 may also mate with the interface element 155 and cable assembly 110 to form a fully enclosed audio delivery assembly, such as an earbud. In some embodiments, the body 315 includes a molded polymer or plastic material that fully encloses the output assembly structural element 275 and the output electrical assembly 107 elements. In this configuration, the interface element 155 may be disposed over a portion of the body 315, and engage with a feature formed in the body 315 so that the interface element 155 can be retained thereon.

As briefly discussed above, the output assembly structural element 275 includes the device load support 276 that is configured to directly and/or indirectly support the various output electrical assembly 107 elements and engage with a portion of the cable assembly 110. The device load support 276 can be a molded plastic or a machined metal part that includes a load supporting feature 305 and cable guiding feature 304 that are adapted to engage with the load supporting elements 230 and wiring harness 220 elements, respectively. In this configuration, the load supporting elements 230 are coupled to the load supporting feature 305 of the device load support 276. At the load supporting feature 305, the load supporting elements 230 are intertwined with features formed in device load support 276 to distribute any applied force to the audio output assembly 150 and connect the ends of the load supporting elements 230. In one example, the load supporting elements 230 are wrapped around the groove 307 and a support element 306. In one embodiment, the ends of each of load supporting elements 230 are tied together in a knot, clasped together using a clip, bonded together, or joined by any other desirable end joining method that can be used after removing any slack and intertwining the load supporting elements 230 around the load supporting feature 305. In another embodiment, each of the ends of each of load supporting elements 230 are intertwined with the groove 307, which is further adapted to hold or retain a portion of load supporting elements 230 by compression and/or friction created between the load supporting elements 230 and the groove 307.

Referring back to FIG. 3A, the one or more of the wires 222 are electrically coupled (e.g., soldered) to the printed circuit board 353 at the connection point 191. The wires 222 within the wiring harness 220 may also contain one or more bends 308, 309 that are used in conjunction with the load supporting elements 230 to reduce or prevent an applied force from being transmitted to the connection point 191. The bends 308, 309 may each include a radius of curvature that extends over an angle between about 15 and 135 degrees. In this configuration, an applied force will only tend to take up the provided slack, or provided excess length, in the flexible wires 222 at the bends 308, 309 versus distribute the applied force to the connection point 191. Also, by positioning and coupling the load supporting elements 230 together so that they have no slack, or excess length, a substantial portion of the applied load will be taken up by the load supporting elements 230 and the device load support 276 versus the electrical connection points 191 when a force is applied to the cable assembly 110 and audio output assembly 150.

Figure 4A:
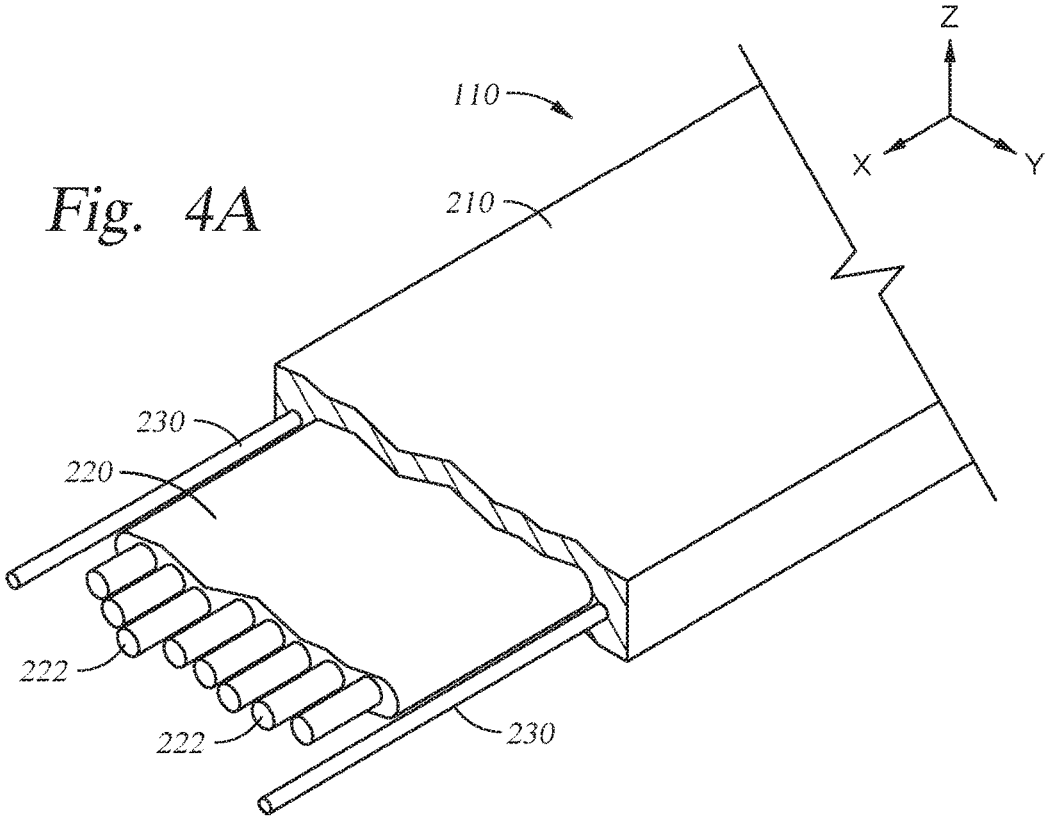
FIGS. 4A-4D are isometric section views of cable assemblies of an audio device assembly according to embodiments of the present disclosure.

In some embodiments of the audio device assembly 100, the wiring harness 220 and load supporting elements 230 in the cable assembly 110 are also configured to reduce or minimize the force supplied to the connection points 191, 192 (FIG. 10) when a force is applied. FIGS. 4A-4D are partial isometric cross-sectional views that illustrate various configurations of the wiring harness 220 and load supporting elements 230 in a portion of the cable assembly 110. FIG. 4A illustrates a configuration of the cable assembly 110 in which the wiring harness 220 includes a plurality of wires 222 that are arranged in a linear and planar orientation (X-Y plane). In this example, the load supporting elements 230 are positioned in an aligned relationship with the wires 222, and are also substantially positioned within the same plane as the plane as the planar orientation of the plurality of wires 222. In this example, the load supporting elements 230 are also positioned in a substantially parallel relationship with the wires 222 to allow the load supporting elements 230 to take up at least a portion of the load applied to the wires 222. Also, while the stiffness of the cable assembly in the X-Y plane will be relatively high as compared to the stiffness of the cable assembly 110 in the Z-direction, this configuration allows the cable assembly 110 to be easily folded over itself in the X-Z plane to allow for easy storage of the audio device assembly 100.

Figure 4B:
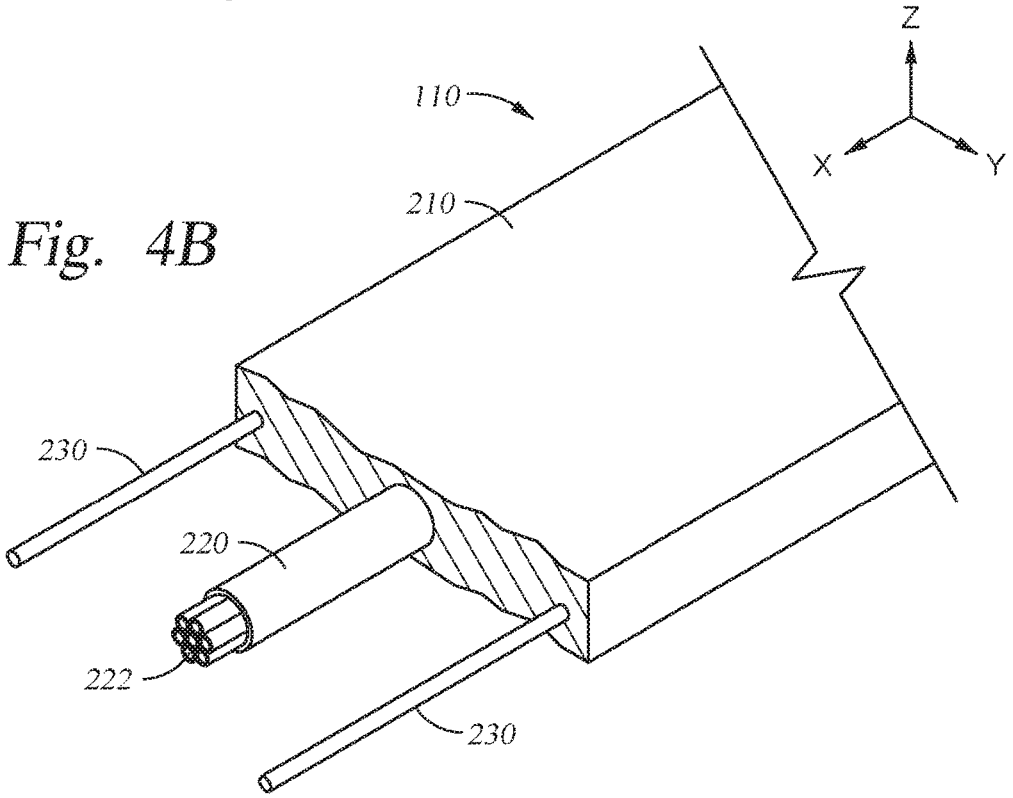

FIG. 4B illustrates a configuration of the cable assembly 110 in which the wiring harness 220 includes a bundle of wires 222 that may include a plurality of smaller stranded wires that are oriented in a straight or twisted manner. In this example, the load supporting elements 230 are aligned with the central axis of the bundle of wires 222. In one example, two or more load supporting elements 230 are substantially aligned with a plane that also contains the central axis of the bundle of wires 222. The stiffness of the cable assembly 110 in this configuration will tend to be more uniform in the Y and Z directions, but may lead to an unwanted rigidity in cable assembly 110 in the X-direction that can affect the ability of the load supporting elements 230 to take up an applied tensile load at the connection points.

Figure 4C:
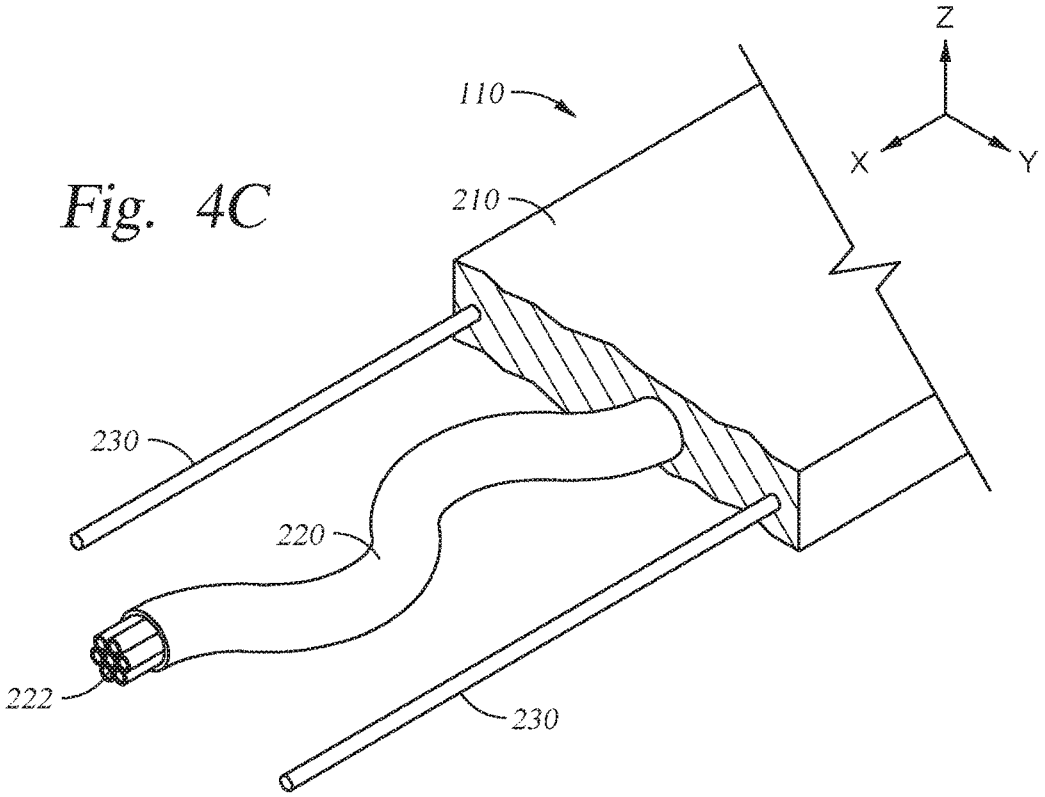

FIG. 4C illustrates a configuration of the cable assembly 110 in which the wiring harness 220 includes a bundle of wires 222 that are distributed in a non-straight or non-parallel orientation relative to the central axis (X-direction) of the cable assembly 110. The wires 222 may also be oriented in a non-straight or non-parallel relationship to the load supporting elements 230 that extend between the central structural element 270 and output assembly structural element 275. In this example, the load supporting elements 230 are aligned with the central axis of the cable assembly 110 (X-direction) that is aligned with a projection of a line, on the X-Y plane, that extends between the connection points of the wires 222. In this configuration, the stiffness of the cable assembly 110 the rigidity of the bundle of wires 222 in the X, Y and Z-directions will be low, which will allow the load supporting elements 230 to more easily take up any applied tensile load and allow the cable assembly 110 to be easily folded up for easy storage of the audio device assembly 100.

Figure 4D:
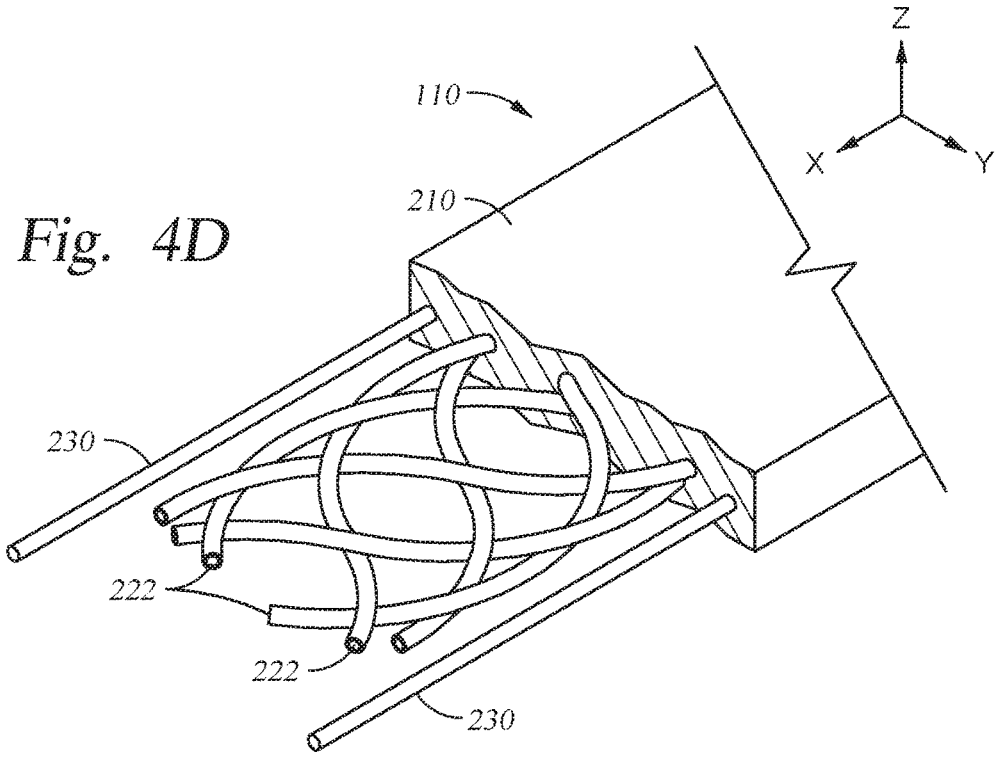

FIG. 4D illustrates a configuration of the cable assembly 110 in which the wiring harness 220 includes an array of wires 222 that are distributed in a non-straight orientation relative to each other and to the axis of the cable assembly 110. The array of wires 222 are also oriented in a non-straight or non-parallel orientation relative of the load supporting elements 230 that extend between the central structural element 270 and output assembly structural element 275. In this example, the load supporting elements 230 are aligned with the central axis of the cable assembly (X-direction) that is aligned with a projection of a line, on the X-Y plane, that extends between the connection points of the wires 222. In this configuration, the stiffness of the cable assembly 110 the rigidity of the bundle of wires 222 in the X, Y and Z-directions will be relatively low, which will allow the load supporting elements 230 to more easily take up any applied tensile load and allow the cable assembly 110 to be easily folded up for easy storage of the audio device assembly 100.

Figure 4E:
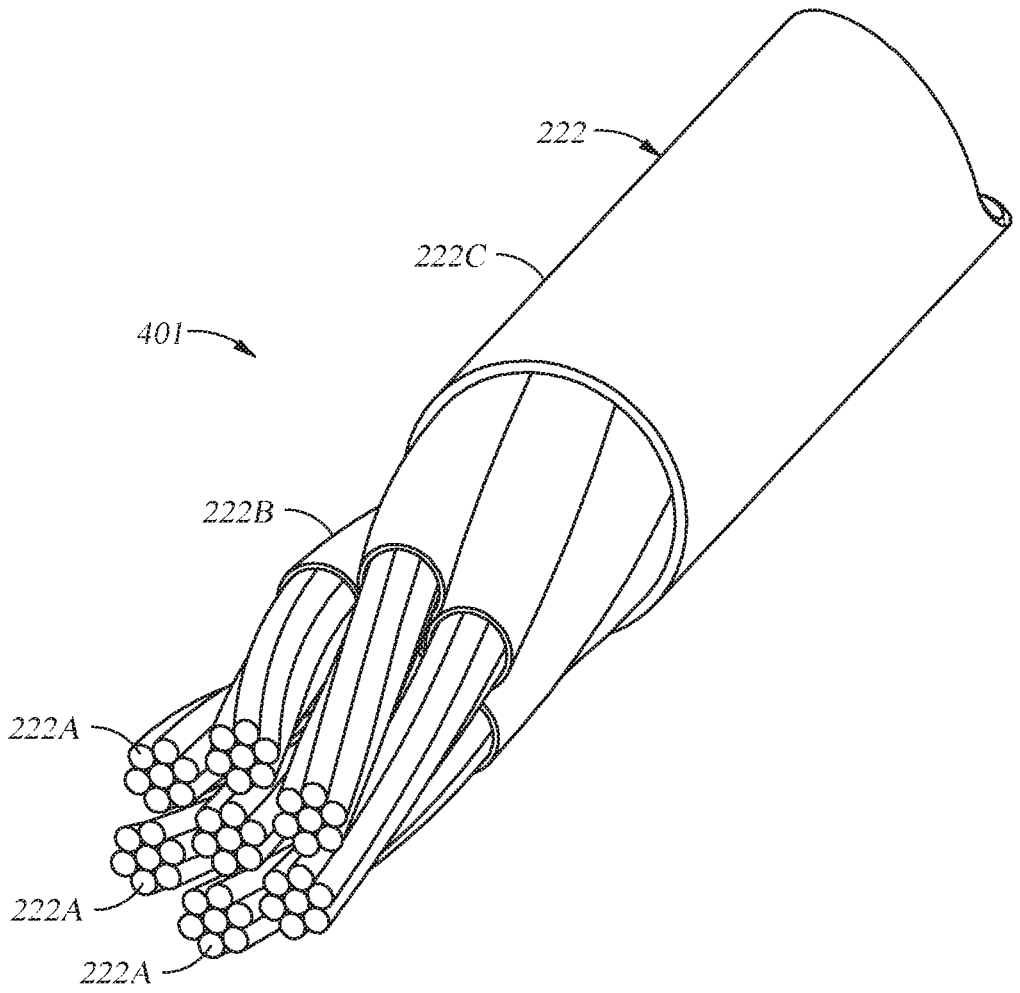
FIG. 4E is an isometric view of a wire bundle that can be used in a cable assembly.

FIG. 4E illustrates an example of a conventional bundle 401 of shielded and twisted wires 222 that can be used in the wiring harnesses 220 illustrated in FIGS. 4B-4C. The wire bundle 401 generally include wires 222 that include a multiple stranded wire 222A that has a shield 222B that electrically isolates the wires 222 from each other. The wire bundle may also include an outer shield 222C that is positioned to further shield the wires 222. The wiring harness 220 design illustrated in FIG. 4E is not intended to limit the scope of the disclosure provided herein, since other less complex wire and shielding configurations can be used.

It is believed that conventional wire strain relief designs that typically use a portion of a wire's shielding (e.g., shield 222B or 222C) to relieve or take up the force(s) applied to a conventional cable in a conventional audio device are ineffective in preventing premature failure of the conventional audio device since it is generally not possible to decouple the applied force taken up by the shielding from the bundled wire(s) due to bonding or friction created between the shielding and the wires. Therefore, since the embodiments of the disclosure provided herein decouple the load bearing elements from the electrical signal carrying components, the forces transmitted to the wiring harness 220 components can be significantly reduced or eliminated over the conventional audio device design. Also, by routing or arranging the decoupled wires 222 in the wiring harness 220 in desired orientations, such as adding bends 226, 227, 308 or 309, the stresses applied to the connection points in the audio device assembly 100 can be further reduced. In some embodiments, it may be desirable to utilize the stress reducing features disclosed herein and additionally couple the wire shielding to a portion of the electrical component to which the electrical connection is made.

User Interface Controls

Referring back to FIG. 1A, the audio device assembly 100 may include an interface assembly 140 that is used to control the delivery of information to the user through the two or more audio output assemblies 150. As noted above, the interface assembly 140 may contain one or more input assemblies 142, 144 and 146 that are each adapted to provide the input to the processor when actuated by the user. However, it has been found that simply positioning an electro-mechanical switch or other similar signal generating components on or adjacent to a portion of the body 210 of the cable assembly 110 does not provide a desirable tactile response to a user when a switch in the input assembly is actuated by the user. Therefore, a novel input assembly configuration is described herein that will provide a reliable, electrically isolated and improved tactile response to the user, when user input is provided to the input assembly 140.

Figure 5:
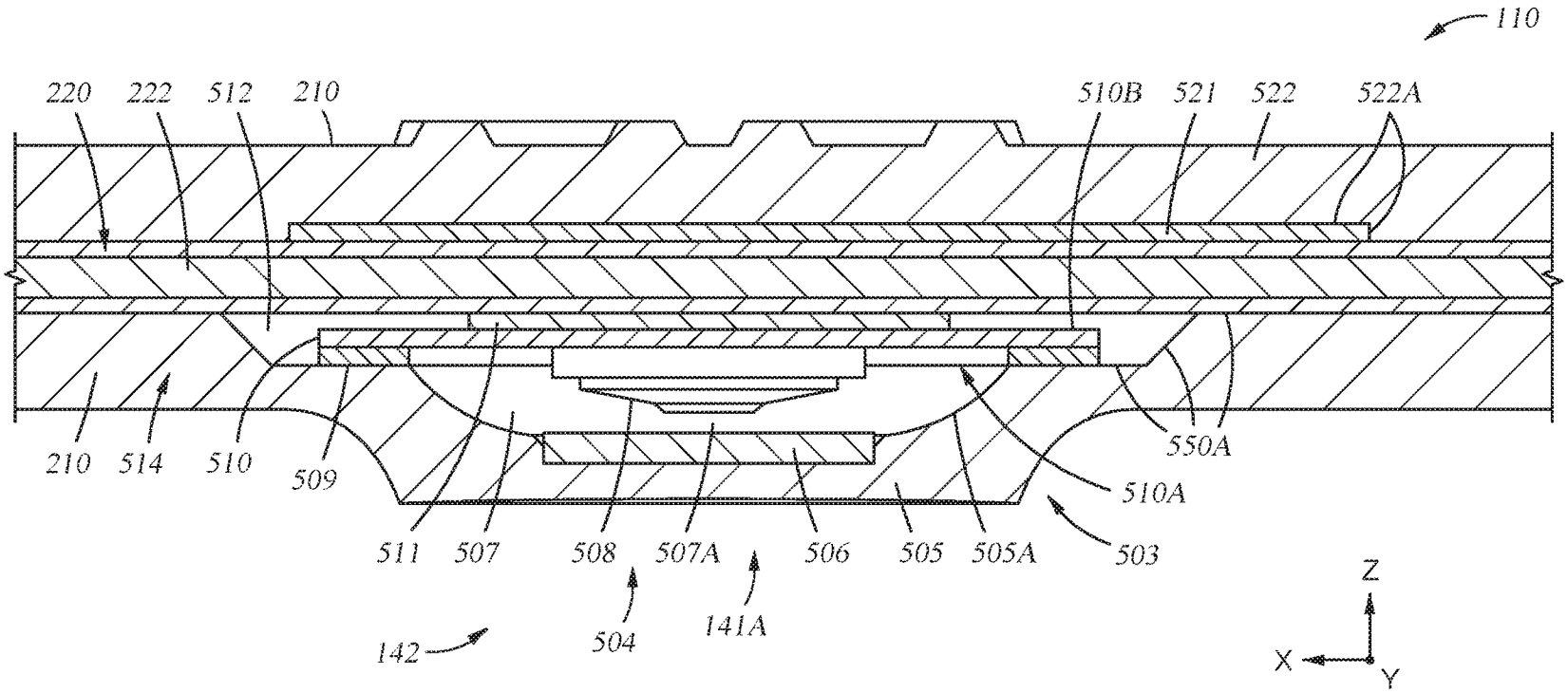
FIG. 5 a side cross-sectional view of an input assembly disposed within a region of the cable assembly, according to one embodiment of the present disclosure.

FIG. 5 is a side cross-sectional view of a representative input assembly, such as input assembly 142, which is disposed within a central portion of one of the sections of the cable assembly 110. The input assembly 142 includes an input receiving feature 141A that is adapted to receive the input from the user, such as by depressing a portion of the input receiving feature to cause an electro-mechanical switch 508 disposed therein to be actuated. The electro-mechanical switch 508 is coupled to one or more components in the wiring harness 220 to provide a signal to the electrical components positioned in the audio output assemblies 150 and/or interconnection assembly 120. In some embodiments, the input assembly 142 includes in input region 504 and a connection region 514 that are isolated from each other by a supporting element 510 and a gasket 509.

The input region 504 is generally defined by the sealed region 507 that is defined by an inner surface 505A of a domed feature 503 formed in the flexible wall 505 of the body 210, a surface 510A of the supporting element 510 and the gasket 509. The domed feature 503 may have any desirable shape or configuration, and thus need not be hemispherically shaped as illustrated in FIGS. 1B and 5. In some embodiments, the supporting element 510 is printed circuit board that contains no through holes or features that allow a fluid to pass between the input region 504 and the connection region 514. The gasket 509 may be a polymeric material and/or adhesive layer that is adapted to form a seal between the surface 510A of the supporting element 510 and the inner surface 505A of the flexible wall 505 to prevent a fluid from passing between the input region 504 and the connection region 514. In this example, the gasket 509 may include a continuous polymeric layer and/or adhesive layer that is disposed around the domed feature 503. It is believed that by providing user input by deforming a part of the domed feature 503 within the flexible wall 505 against the switch 508 that is disposed in the region 507, an improved tactile response is provided to a user. In some configurations, a gap 507A is formed between the switch 508 and the inner surface 505A of the flexible wall 505. In some cases, a plate 506 may be positioned so that the deformed flexible wall 505 does not contact the switch 508 when a force is applied by the user during the action of providing input to the input assembly 142, so that the applied force does not damage the material in the flexible wall 505. The plate 506 may include a thin plastic material, such as PET.

The connection region 514 generally includes a space 512 that is defined by the inner surface 522A of the supporting wall 522 of the body 210, a surface 510B of the supporting element 510 and the gasket 509. The connection region 514 generally includes a portion the wiring harnesses 220 that is electrically connected to switch 508 through one or more connection points (not shown) on the supporting element 510. The connection points may be isolated from each other by a dielectric element 511 that is disposed between the wiring harnesses 220 and the supporting element 510. To provide support to the supporting wall 522 a plastic backing material 521 may be used to bear some of the load supplied by the user to the input assembly 142 and provide electrical isolation for the components in the wiring harnesses 220.

As briefly discussed above, in some configurations of the audio device assembly 100 the body 210 of the cable assembly 110 are formed by use of a single step or multiple step molding process. In this configuration, the walls 505 and 522 of the body 210 may be formed from a moldable elastomeric material, such as a 10 to 90 durometer (Shore A) silicone material.

In some cases, the cable assembly 110 formation process may include the following molding process sequence. First, the flexible wall 505 is formed by molding an elastomeric material into a desired shape. Then a wiring assembly is positioned on a mounting surface 550A of the formed flexible wall 505. The wiring assembly may include the wiring harness 220, at least one supporting element 510 and the printed circuit board 253, which are separately coupled to the wires 222 in the wiring harness 220. During this step the supporting element 510 is bonded to the inner surface of the flexible walls 505 by the gasket 509 to form the sealed region 507. During this step the load supporting elements 230 are also positioned and aligned relative to the wiring harness 220 and/or formed flexible wall 505. Next, the backing material 521 is placed over the wiring harness 220 and the supporting wall 522 is formed on the flexible wall 505, thus enclosing the components disposed on the flexible wall 505 within the walls 505 and 522.

One example of an audio device formation process, may include forming the flexible wall 550 that has a mounting surface 550A and a domed feature 503 formed therein. The domed feature 503 includes an inner surface 505A that is adjacent to or a part of the mounting surface 550A. Next, at least a portion of a wiring assembly is disposed on or over the mounting surface 550A, wherein the wiring assembly includes the wiring harness 220, a supporting element 510, and the switch 508 that has a first connection point that is in electrical communication with a first wire within the wiring harness 220 and a second connection point that is electrical communication with a second wire within the wiring harness 220. Next, sealably bonding and/or mounting the supporting element 510 to the mounting surface 550A to form the sealed region 507. The load supporting elements 230 can then be positioned and/or oriented in an aligned relationship with the wires 222 of the wiring harness 220. In one example, at least a portion of the load supporting elements 230 are aligned in a parallel relationship with the wires 222 or with length of the wiring harness 220 (e.g., X-direction in FIG. 4A-4D) if the wires 222 are oriented in a non-straight configuration (e.g., FIGS. 4C-4D). Then molding, casting or bonding the supporting wall 522 to the flexible wall 550 to enclose the supporting element 510, the switch 508 and at least a portion of the wiring harness 220 and the load supporting elements 230.

The disclosure has been described above with reference to specific embodiments. Various embodiments may be used in alone or in combination. Persons skilled in the art, however, will understand that various modifications and changes may be made thereto without departing from the broader spirit and scope of the disclosure as set forth in the appended claims. The foregoing description and drawings are, accordingly, to be regarded in an illustrative rather than a restrictive sense.

The invention claimed is:

1. An audio device, comprising:

an audio assembly comprising a first device load support and a first electrical input connection that is in electrical communication with a first speaker, wherein the first device load support is configured to support the first speaker;

an electrical interface assembly comprising an interface connection and an interface load support, wherein the interface connection is in electrical communication with interface control electronics; and a cable assembly comprising:

a wiring harness comprising a plurality of wires that electrically connect the first electrical input connection to the interface connection; and a first load supporting element that extends between and is coupled to the first device load support and the interface load support, wherein the first load supporting element and the wiring harness are spaced a distance apart allowing relative movement between the wiring harness and the first load supporting element when a tensile load is applied to the first device load support relative to the interface load support.

2. The audio device of claim 1, wherein the wiring harness further comprises a bend that is disposed in a first position between the first electrical input connection and the interface connection, and the bend includes a first radius of curvature, and the first load supporting element does not contain a bend at the first position.

3. The audio device of claim 1, wherein the audio assembly further comprises:

a second device load support; and a second electrical input connection that is in electrical communication with a second speaker, wherein the second device load support is configured to support the second speaker, and the cable assembly further comprises:

a second wiring harness comprising a plurality of wires that electrically connect the second electrical input connection to the interface connection; and a second load supporting element that extends between and is coupled to the second device load support and the interface load support, wherein the second load supporting element and the second wiring harness are spaced a distance apart.

4. The audio device of claim 1, wherein the electrical interface assembly further comprises a printed circuit board that includes the interface connection, wherein the printed circuit board is positioned adjacent to the interface load support and is free to move in at least one direction relative to the interface load support.

5. The audio device of claim 4, wherein the electrical interface assembly further comprises a computer device connector that is in electrical communication with the printed circuit board.

6. The audio device of claim 1, further comprising a molded feature that is coupled to the interface load support and the wiring harness.

7. The audio device of claim 1, wherein the wiring harness and the first load supporting element are spaced apart and are disposed in a parallel relationship between the audio assembly and the electrical interface assembly.

8. The audio device of claim 1, wherein the plurality of wires comprise two or more wires, and the first load supporting element comprises two or more load supporting members that are coupled to the first device load support and the interface load support.

9. The audio device of claim 8, wherein the two or more wires are aligned parallel to a first plane, and the two or more load supporting members are aligned parallel to the first plane.

10. The audio device of claim 1, wherein the first load supporting element comprises a first material and the plurality of wires comprise a copper material.

11. The audio device of claim 10, wherein the first material comprises an ultrahigh molecular weight polyethylene material or an aramid fiber.

12. The audio device of claim 1, wherein the cable assembly further comprises:

a flexible wall having a domed feature that has an inner surface;

a supporting wall;

a supporting element that is sealably bonded to a portion of the flexible wall, and is disposed between the flexible wall and the supporting wall;

a switch that is disposed on a support surface of the supporting element, wherein a first connection point and a second connection point of the switch are each in electrical communication with one of the plurality of wires of the wiring harness; and a sealed region at least partially defined by the inner surface and the support surface, wherein at least a portion of the switch is disposed within the sealed region.

13. An audio device, comprising:

a first audio assembly comprising:

a first device load support; and a first electronic assembly comprising a first electrical input connection that is in electrical communication with a first speaker;

an electrical interface assembly comprising:

a first interface connection and a second interface connection that are each coupled to an interface printed circuit board; and an interface load support; and a first cable assembly comprising:

a wiring harness comprising a plurality of wires that electrically connect the first electrical input connection to the first interface connection; and a first load supporting element that extends between and is coupled to the first device load support and the interface load support, wherein the first load supporting element and the wiring harness are spaced a distance apart allowing relative movement between the wiring harness and the first load supporting element when a tensile load is applied to the first device load support relative to the interface load support.

14. The audio device of claim 13, further comprising:

a second audio assembly comprising:

a second device load support; and a second electronic assembly comprising a second electrical input connection that is in electrical communication with a second speaker; and a second cable assembly comprising:

a wiring harness comprising a plurality of wires that electrically connect the second electrical input connection to the second interface connection; and a second load supporting element that extends between and is coupled to the second device load support and the interface load support, wherein the second load supporting element and the wiring harness of the second cable assembly are spaced a distance apart.

15. The audio device of claim 13, wherein the wiring harness further comprises a bend that is disposed in a first position between the first electrical input connection and first interface connection, and the bend includes a first radius of curvature, and the first load supporting element does not contain a bend at the first position.

16. The audio device of claim 13, wherein the electrical interface assembly further comprises a computer device connector that is in electrical communication with the interface printed circuit board.

17. The audio device of claim 13, further comprising a molded feature that is coupled to the interface load support and the wiring harness.

18. The audio device of claim 13, wherein the wiring harness and the first load supporting element are disposed in a parallel relationship between the audio assembly and the electrical interface assembly.

19. The audio device of claim 13, wherein the plurality of wires comprise two or more wires, and the first load supporting element comprises two or more load supporting members that are coupled to the first device load support and the wiring harness mount.

20. The audio device of claim 19, wherein the two or more load supporting members comprises an ultra-high molecular weight polyethylene material or an aramid fiber.

21. The audio device of claim 1, wherein the first load supporting element comprises two supporting members that are coupled to the first device load support and the interface load support, and the wiring harness extends in a space between the two supporting members.

22. The audio device of claim 1, wherein the wiring harness and the first load supporting element are enclosed in a body of the cable assembly.

23. The audio device of claim 1, wherein the wiring harness further comprises a plurality of shields, wherein at least a portion of each wire of the plurality of wires is disposed within a different shield.

24. The audio device of claim 23, wherein the wiring harness further comprises an outer shield in which the plurality of shields are disposed.

* * * * *